US006769793B2

(12) United States Patent
Hornsby et al.

(10) Patent No.: US 6,769,793 B2
(45) Date of Patent: Aug. 3, 2004

(54) EXPANDABLE DECORATION

(75) Inventors: James R. Hornsby, St. Louis, MO (US); Joseph L. McGowan, St. Charles, MO (US); Marcellus R. Benson, St. Louis, MO (US); Chad P. Stuemke, St. Louis, MO (US)

(73) Assignee: All Season Toys, Inc., Malibu, CA (US)

( * ) Notice: Subject to any disclaimer, the term of this patent is extended or adjusted under 35 U.S.C. 154(b) by 133 days.

(21) Appl. No.: 09/952,561

(22) Filed: Sep. 12, 2001

(65) Prior Publication Data

US 2002/0118539 A1 Aug. 29, 2002

Related U.S. Application Data

(60) Provisional application No. 60/232,286, filed on Sep. 13, 2000.

(51) Int. Cl.[7] ..... F21V 1/06

(52) U.S. Cl. ..... 362/352; 362/450; 362/806; 362/357

(58) Field of Search ..... 362/418, 395, 362/449, 450, 352, 806, 361, 357

(56) References Cited

U.S. PATENT DOCUMENTS

| | | | | |
|---|---|---|---|---|
| 5,031,299 | A | | 7/1991 | Lovik |
| 5,195,638 | A | | 3/1993 | Zinbarg |
| 5,526,243 | A | | 6/1996 | Masters |
| 5,567,045 | A | | 10/1996 | Bucek |
| 5,607,734 | A | | 3/1997 | Gonzalez |
| 5,629,057 | A | | 5/1997 | Wang et al. |
| 5,672,396 | A | | 9/1997 | Zinbarg et al. |
| 5,758,948 | A | | 6/1998 | Hale |
| 5,776,578 | A | | 7/1998 | Dejaynes |
| 5,814,380 | A | | 9/1998 | Tamborello et al. |
| 5,893,636 | A | * | 4/1999 | Babineaux ..... 362/352 |
| 6,305,827 | B1 | * | 10/2001 | Nolle ..... 362/352 |

* cited by examiner

*Primary Examiner*—Alan Cariaso
*Assistant Examiner*—Guiyoung Lee
(74) *Attorney, Agent, or Firm*—Dorsey & Whitney LLP

(57) ABSTRACT

A cover surrounds an expandable frame that, when expanded, shapes the cover in a decorative fashion. The frame includes a plurality of flexible rods interconnected between two base units. As the base units are moved towards one another, the rods flex outwardly to form a somewhat spherical configuration. The rods are tapered at one or both ends to help facilitate a circular curvature.

12 Claims, 11 Drawing Sheets

EXPANDABLE DECORATION

CROSS-REFERENCE TO RELATED APPLICATIONS

This application claims priority from Provisional Application No. 60/232,286, dated Sep. 13, 2000.

FIELD OF THE INVENTION

The present invention relates to decorative and/or display devices. More specifically, the present invention relates to decorative and/or display devices that are expandable.

BACKGROUND OF THE INVENTION

People display decorative devices for a wide variety of reasons. For example, during the holidays people display various items relevant to that holiday. For instance, during the Christmas season these people might display a Santa Claus or a snowman. Around Halloween, they might display a pumpkin, a witch or any number of other seasonal items. Often, people desire to reuse these decorative items on a yearly basis. Such reuse presents the additional consideration of storing the decorative item during the remainder of the year. Thus, the larger and more elaborate the display, the more storage space that is required when not in use.

BRIEF SUMMARY OF THE INVENTION

In one embodiment, the present invention comprises an expandable and collapsible decoration or decorative object comprising a frame, a flexible body carried by the frame, and an internal lighting assembly. In one embodiment, the lighting assembly is carried by a telescoping, rod-like portion of the frame and, in another embodiment, the lighting assembly is carried by a base member of the frame. In one embodiment, the frame comprises movable members which may be reconfigured, and the body comprises a thin, flexible skin or cover, all or portions of which may be transparent, semi-transparent or opaque. In some embodiments, the present invention may include a frame comprising a number of generally or at least partially flexible rods for helping to support the body. In some embodiments, the rods may be shaped, tapered or otherwise conditioned, e.g., near the ends thereof, to facilitate bending or positioning them for optimizing a selected expanded or collapsed shape of the invention.

In some embodiments of the present invention, including those in which a light source is supported or carried by the base member, the frame includes a top member and an adjacent guide/support disk with a central opening. The central opening is sized to generally closely receive a bead and a elongated guide pin member both operably carried by a generally central flexible member used to shape the object, and to optionally hang it for display. The bead serves to lock the object in an expanded position, and the guide pin helps prevent the flexible member and/or bead from fouling or tangling as the object is changed from its expanded to its collapsed state. In some embodiments, the bead and guide pin may be integrated to provide further prevention of fouling.

The decorative device weighs very little and can be collapsed for convenient transportation and/or storage.

In some embodiments, the configuration of the decorative object or device of the present invention, particularly of the body when the object is expanded, may be varied, e.g., it may appear to be a pumpkin, a holiday ornament, an imaginary or whimsical creature, a geometric figure, or virtually any selected representation or object. Luminous or "glow-in-dark" features may be provided, and the various embodiments may include graphics or colors as desired. In some embodiments, the base member of the frame is annular and includes a bottom member and a top member for capturing and/or supporting a potion of the rods. The central opening may be adapted to received generally interchangeable base plate members, one of which may be adapted to support or carry a light source carrying battery compartment, and one of which may be adapted to receive a Christmas-type bulb. Any bulb and socket type may be used, for example, screw-in, snap-in, press fit or bayonet types may be used.

Any references to front and back, right and left, top and bottom, upper and lower, and horizontal and vertical are intended for convenience of description, not to limit the present invention or its components to any one positional or spatial orientation.

While multiple embodiments are disclosed, still other embodiments of the present invention will become apparent to those skilled in the art from the following detailed description, wherein is shown and described only the embodiments of the invention, by way of illustration, of the best modes contemplated for carrying out the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
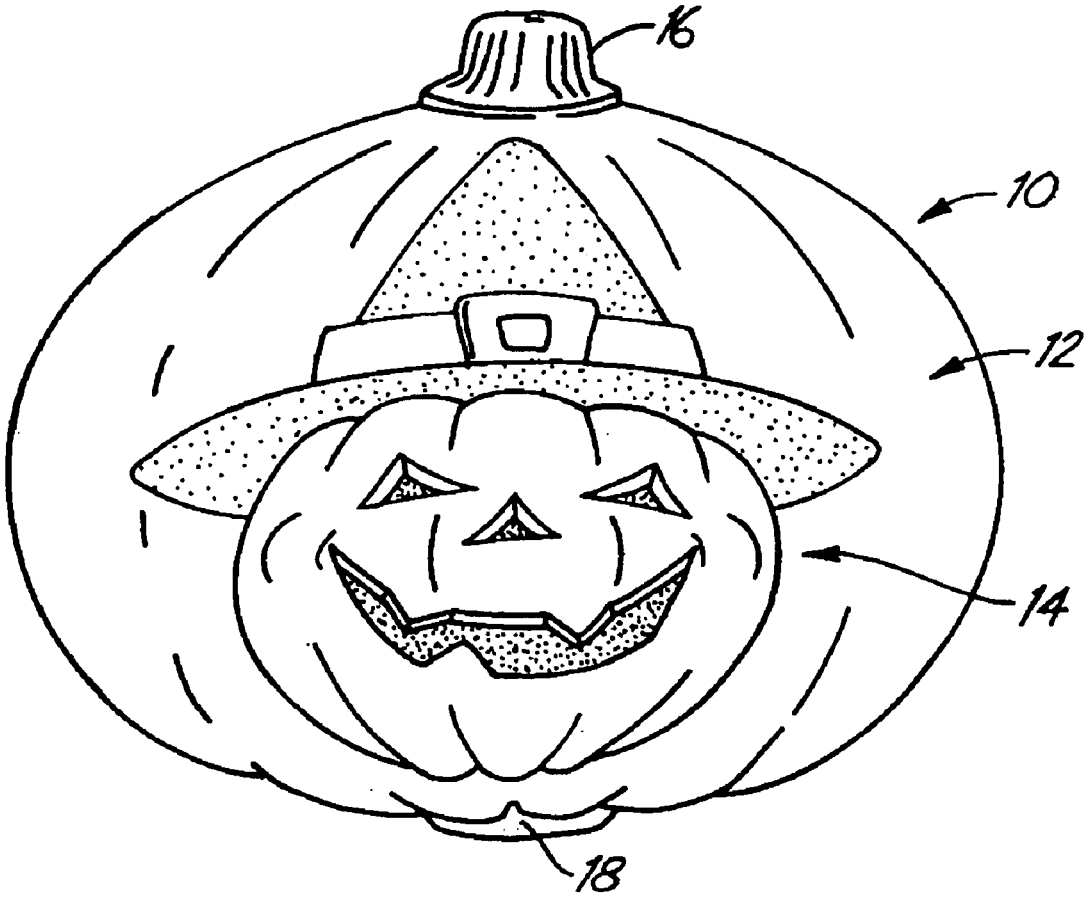
FIG. 1 is a front elevational view of an expandable decoration, consistent with the principals of the present invention.

Referring to FIG. 1, an expandable decoration is illustrated and generally referred to as 10. A flexible cover 12 substantially defines the outer portion of expandable decoration 10, while top base 16 and lower base 18 respectively define upper and lower extremes. FIG. 1 illustrates expandable decoration 10 in an expanded position, wherein cover 12 is pushed from the inside out to form a somewhat spherical, or rather an oblong or elliptical three dimensional structure. Of course, the present invention can achieve various other geometrical shapes and configurations. Cover 12 may include various designs 14 or patterns. Cover 12 may be translucent or opaque and my include any number of colors, designs or patterns. By way of example only, design 14 is illustrated as including a jack-O-lantern pattern. Cover 12 may be formed from any number of materials including cloth, plastic, paper or any other suitable flexible material.

Figure 2:
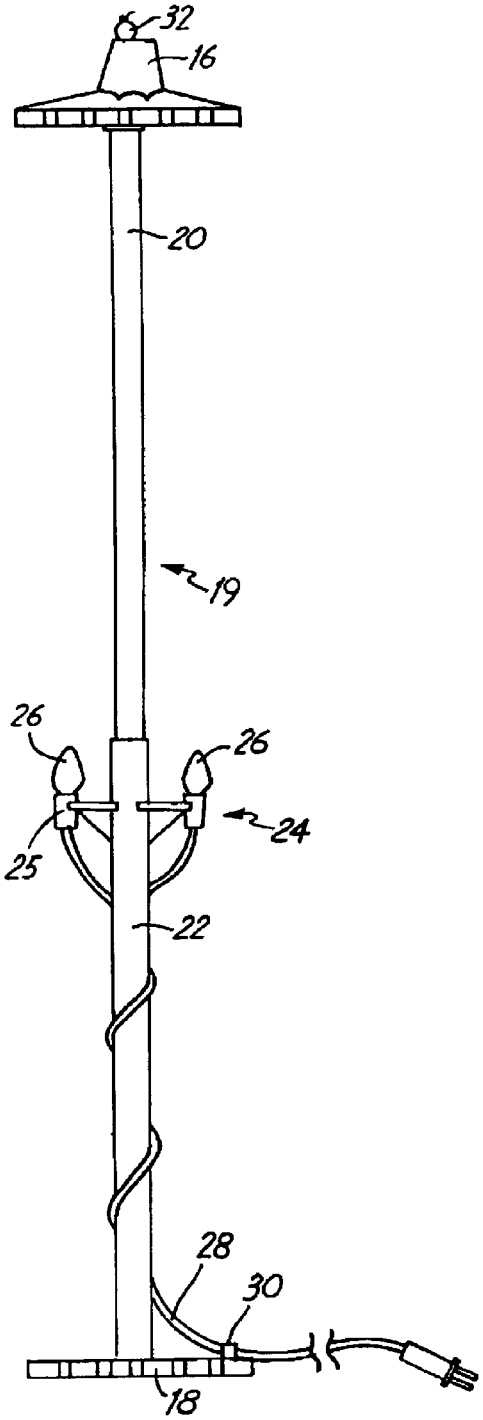
FIG. 2 is front elevational view of a telescoping assembly consistent with the principals of the present invention.

As will be explained in greater detail below, expandable decoration 10 moves from the expanded position illustrated in FIG. 1 to a collapsed position suitable for storage. FIG. 2 illustrates a telescoping assembly 19 that facilitates the movement from the expanded position to the collapsed position and vice versa. In particular, telescoping assembly 19 includes a cylindrical top pole 20 that slidably engages with a cylindrical bottom pole 22. That is, bottom pole 22 at least partially receives top pole 20. Top base 16 attaches to top pole 20 while bottom base 18 attaches to bottom pole 18. Thus, as bottom pole 22 receives top pole 20, top base 16 and bottom base 18 move towards one another.

Telescoping assembly 19 is located within the interior of expandable decoration 10. Thus, lighting assembly 24 couples with telescoping assembly 19 and is likewise positionable within expandable decoration 10. Lighting assembly 24 includes one or more light fixtures 25 coupled with one or more bulbs 26. Power cord 28 provides an appropriate source of power and may be affixed or secured to bottom base 18 via a clip 30 or other appropriate device.

Figure 3A:
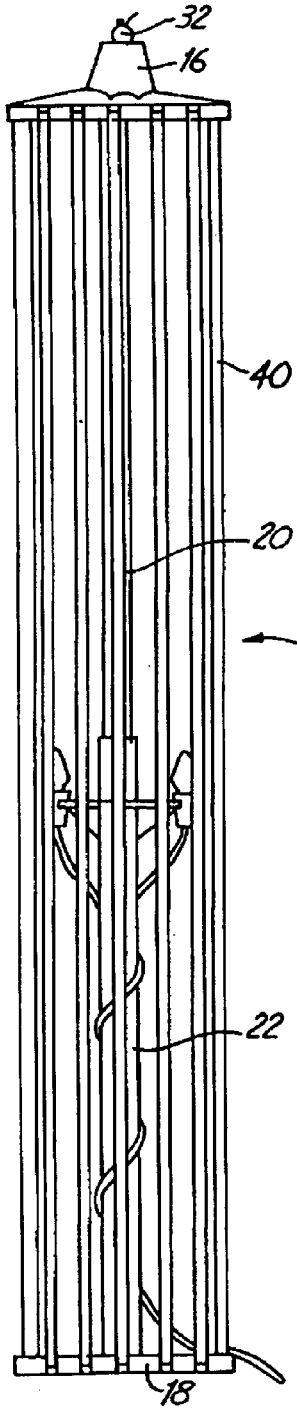
FIG. 3A is a front elevational view of a frame assembly consistent with the principals of the present invention.
Figure 3B:
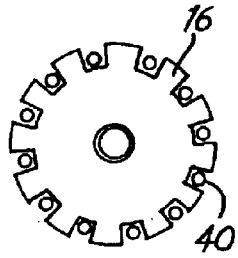
FIG. 3B is a top, planar view of the frame assembly of FIG. 3A.
Figure 3C:
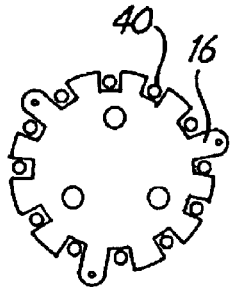
FIG. 3C is a bottom, planar view of the frame assembly of FIG. 3A

Referring to FIG. 3A, a plurality of flexible rods 40 are disposed between top base 16 and bottom base 18, to prevent top pole 20 from sliding into bottom pole 25. When assembled as shown in FIG. 3A, rods 40, top base 16 and bottom base 18 form a frame assembly 21, over which cover 12 may be positioned. Causing top base 16 and bottom base 18 to move towards one another causes rods 40 to flex and expand in a generally horizontal direction, as illustrated. FIGS. 3B and 3C illustrate the interconnection of rods 40 with top and bottom bases 16, 18 respectively.

Figure 4B:
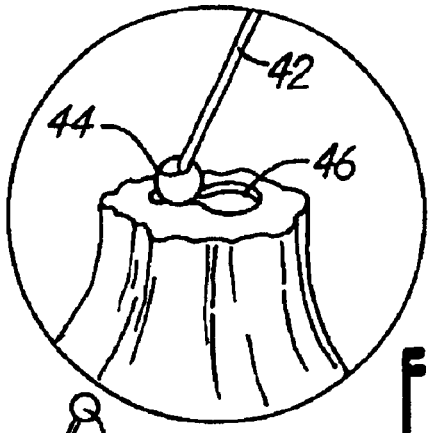
FIG. 4B is a perspective view of a key-hole assembly located on an upper portion of the frame assembly of FIG. 4A.
Figure 4A:
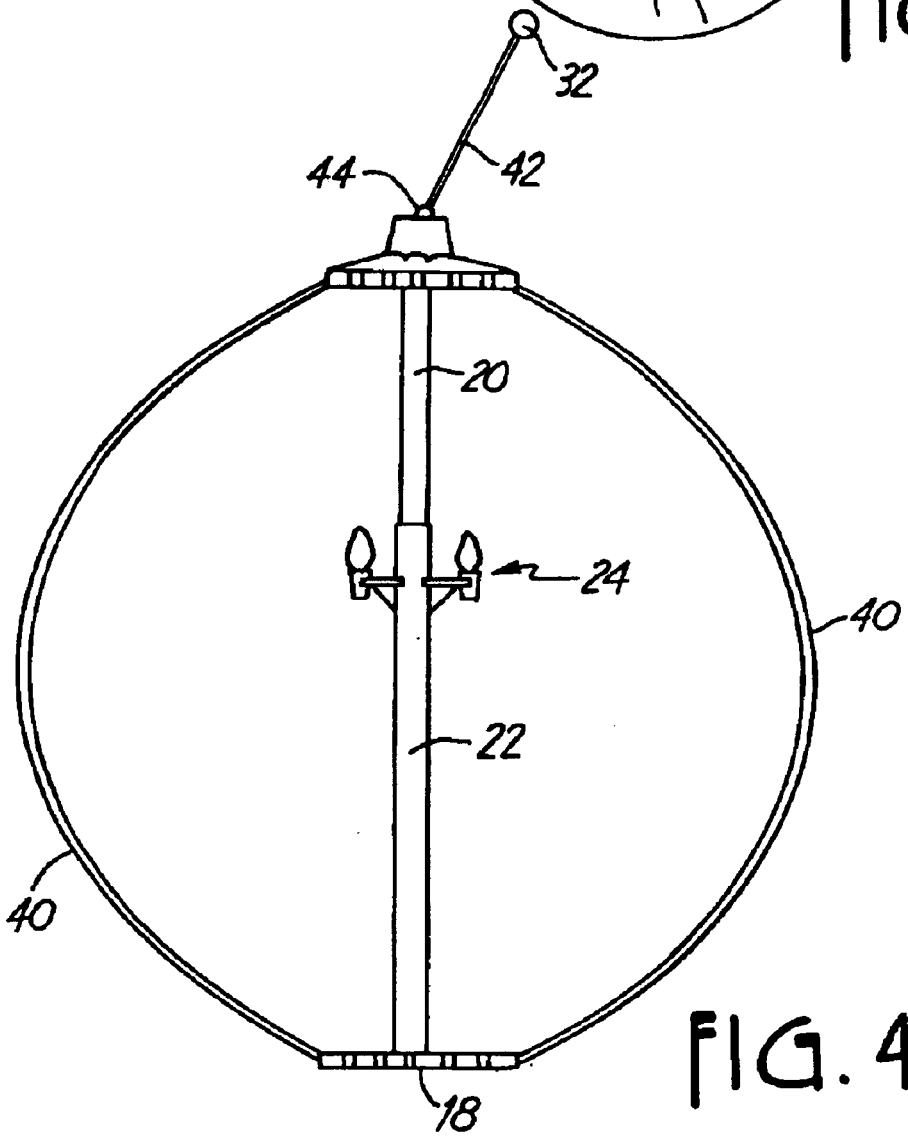
FIG. 4A is a side elevational view of a potion of a frame assembly in a flexed position.

FIGS. 4A and 4B illustrate one mechanism for causing top base 16 and bottom base 18 to move towards one another. In particular, a cord 42 is anchored to bottom base 18 and passes through bottom tube 22, top tube 20 and top base 16. Cord 42 includes a top bead 42 sized to prevent cord 42 from slipping through top base 16. A medially disposed catch bead 44 is able to pass through a wider portion of key-hole slot 46, but not a narrower portion. Thus, as cord 42 is pulled, cord 42 can be anchored into position by pulling catch bead 44 through key-hole slot 46 and sliding cord 42 into the narrower portion as illustrated. As cord 42 is so pulled, rods 40 flex allowing top base 16 and lower base 18 to move towards one another. Because of the tension produced, cord 42 should be formed from a sufficiently strong material such as a nylon cord or other suitable material. To release rods 40, cord 42 is pull slightly and catch bead 44 is allowed to pass through the wider portion of key hole slot 46.

Figure 5:
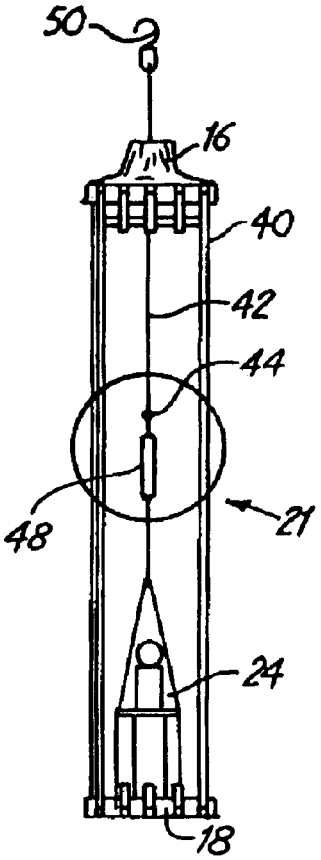
FIG. 5 is a side elevational view of a frame assembly and a cable assembly.
Figure 6A:
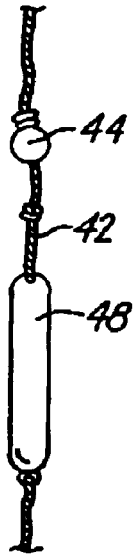
FIG. 6A is a side elevational view of a two piece cable assembly consistent with the principals of the present invention.
Figure 6B:
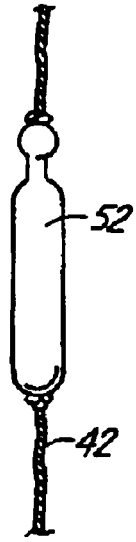
FIG. 6B is a side elevational view of a one piece cable assembly consistent with the principals of the present invention.

FIG. 5 illustrates the relative position of catch bead 44 within frame 21 when in a collapsed position. FIG. 6A illustrates a guide pin 48 that can be positioned just below catch bead 44. Guide pin 48 serves to guide cord 42 through key hole slot 46 without allowing cord 42 to become tangled or otherwise caught. FIG. 6B illustrates a one piece catch bead and guide assembly 52 that also serves to guide cord 42. Without having a portion of cord 42 between the bead portion and the guide portion, the one piece assembly may function more efficiently.

Figure 7:
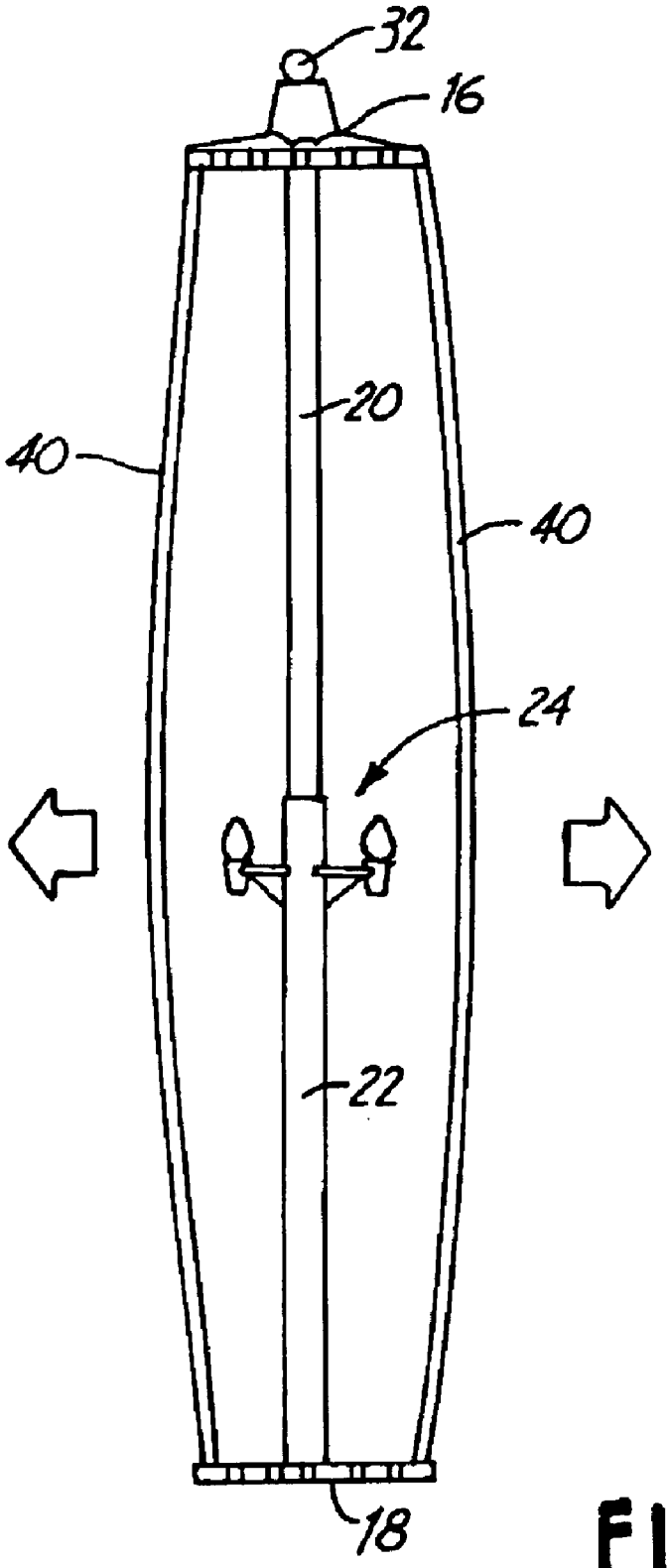
FIG. 7 is a side elevational view of a frame assembly under tension.

Because rods 40 are pivotally connected at each end, it is possible for them to flex inwardly, towards telescoping assembly 19. As this would generally be undesirable when trying to expand decoration 10, FIG. 7 illustrates the mechanism by which this inward flexing is prevented. That is, even in the collapsed position, rods 40 (only two of which are illustrated for clarity) are retained under some tension so a minimal outward flex is achieved. In other words, when decoration 10 is expanded, rods 40 are already slightly biased outward and will continue to flex in the same manner and direction. There are various methods that can be employed to retain a slight flex in rods 40 when in the collapsed position. For example, cord 42 can have a length such that top bead 32 engages top base 16 as illustrated, thus preventing further separation of top base 16 and bottom base 18. Alternatively, various other latch mechanisms can be employed within telescoping assembly 19 to limit the amount of travel.

Figure 8:
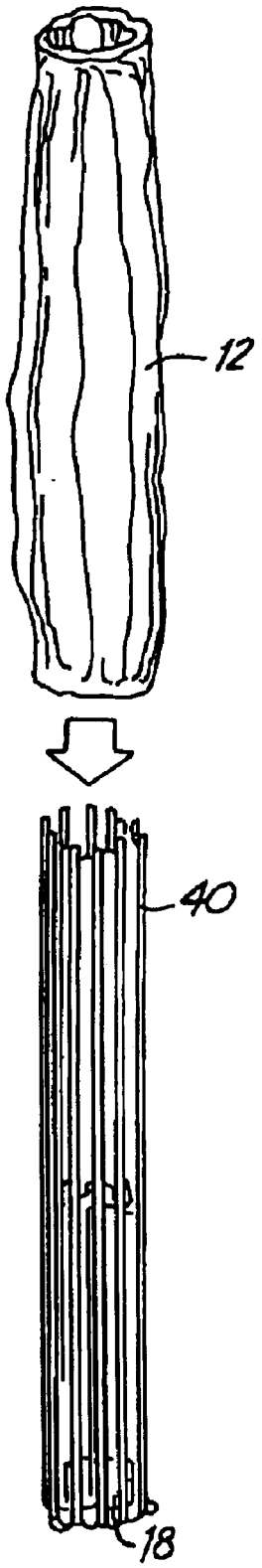
FIG. 8 is a side elevational view illustrating the assemblage of a cover and frame assembly consistent with the principals of the present invention.
Figure 9:
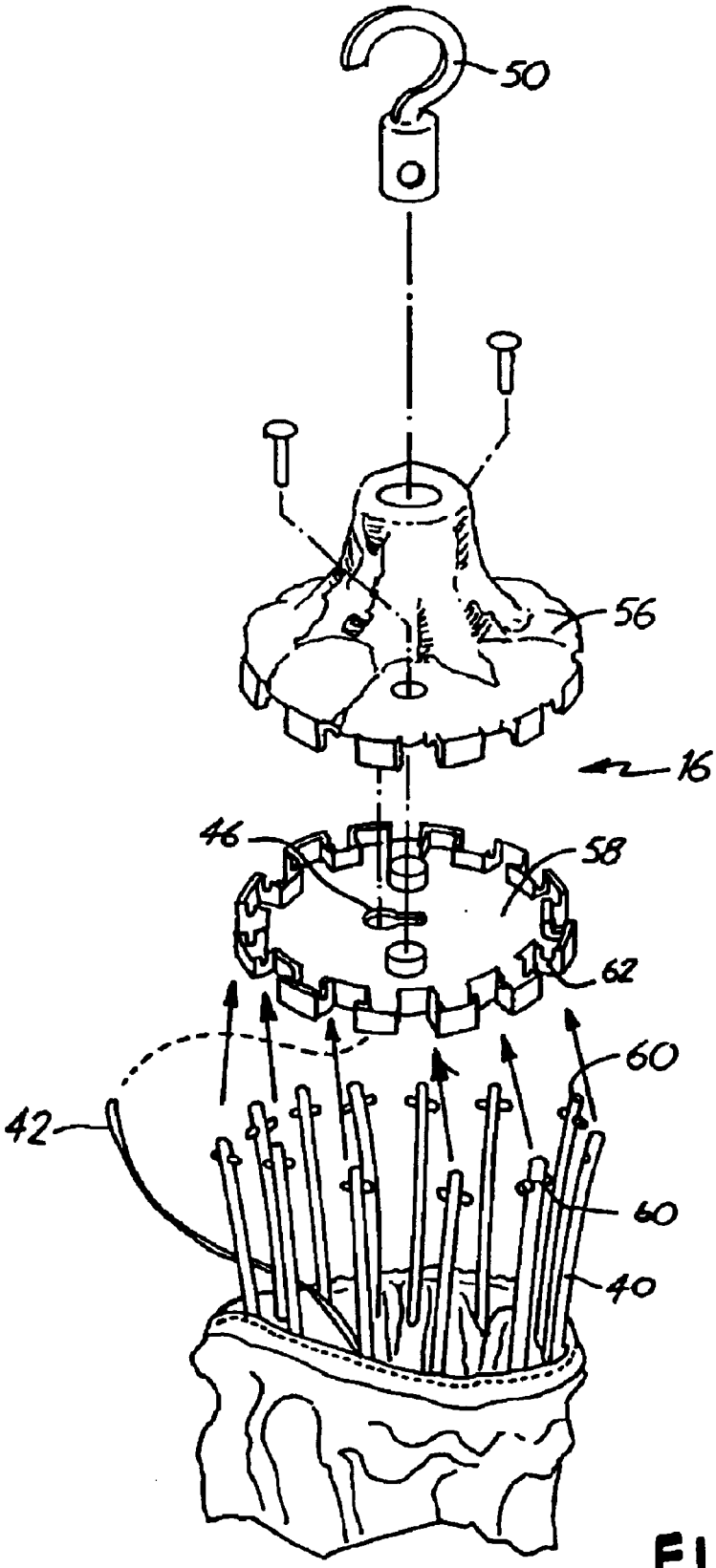
FIG. 9 is an exploded perspective view of a top base assembly and a plurality of rods consistent with the principals of the present invention.

To assemble expandable decoration 10, rods 40 are coupled with bottom base 18. Cover 12 is then placed over rods 40 as illustrated in FIG. 8. Cover 12 may simply be a hollow shell that accepts rods 40 within an interior portion. Alternatively, cover 12 may have individual pockets or other structures to receive an individual rod 40. After positioning cover 12, rods 40 are attached to top base 16, as illustrated in FIG. 9. Top base 16 includes an upper portion 56 and a lower portion 58 that can be secured together by screws, bolts, clamps, interlocking elements, or any other suitable device. Each rod 40 terminates in a T-connector 60. Each T-connector 60 is seated in an individual receiving slot 62 located on lower portion 58. Once all of the rods are so seated, upper portion 56 is coupled with lower portion 58, trapping the various T-connectors 60 in place. That is, rods 40 are able to pivot in one plane, but are otherwise generally retained in place. Cord 42 is threaded from lower base 18 and through top base 16. An optional handle 50 can be attached to top base 16 to allow decoration 10 to be hung or otherwise secured.

Figure 10:
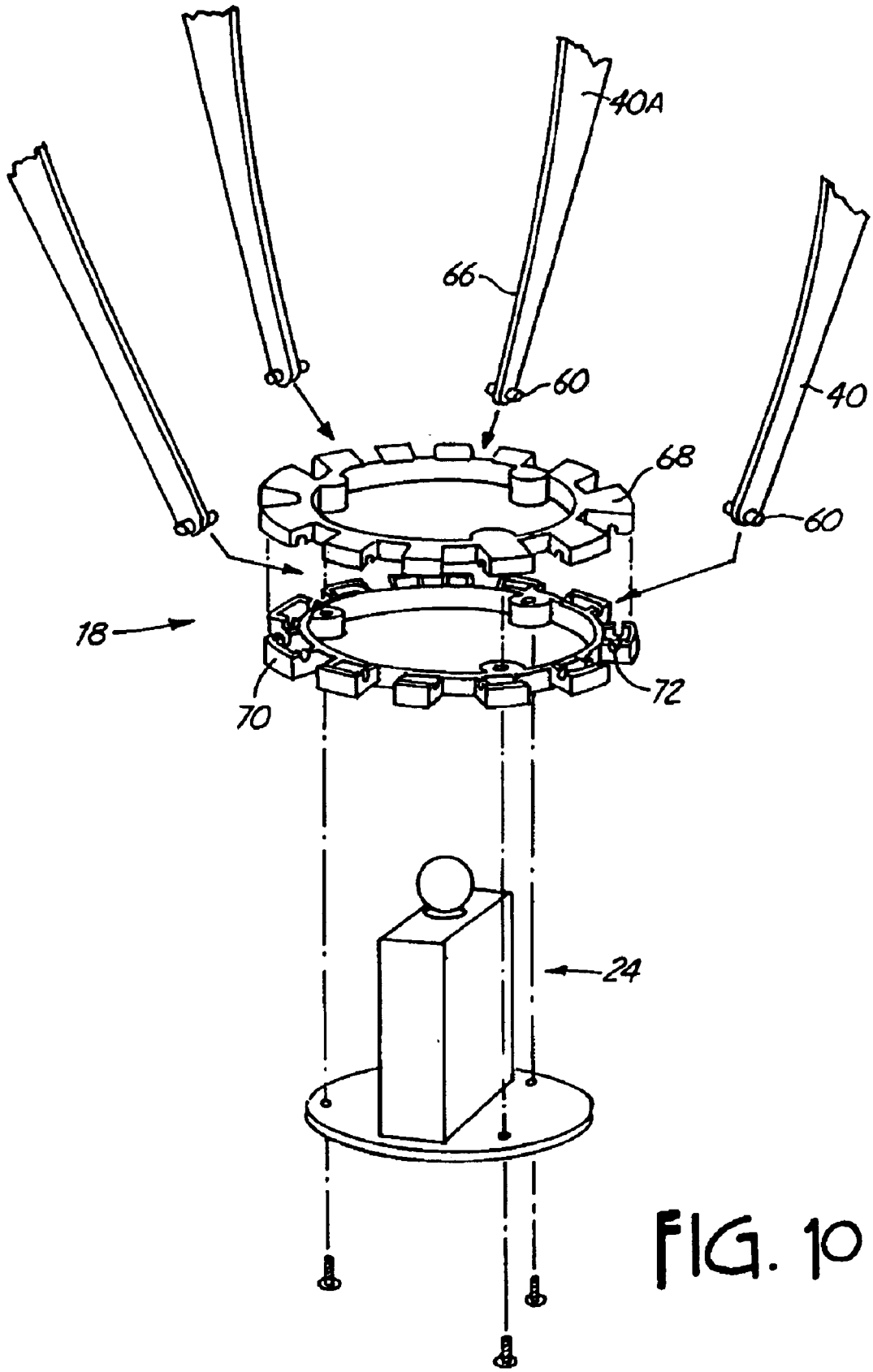
FIG. 10 is an exploded perspective view of a lower base assembly and a plurality of rods consistent with the principals of the present invention.

FIG. 10 illustrates that lower base 18 also has an upper portion 68 and a lower portion 70 that are coupleable to secure T-connectors of rods 40 therebetween. FIG. 10 also more clearly illustrates rods 40. With particular reference to rod 40A, a first end 64 of rod 40A includes the above described T-connector 60. In addition, first end 64 is tapered. That is, first end is thinner near T-connector 60 and gradually thickens in a direction moving away from T-connector 60. In one embodiment, this taper is present on each end of each rod 40. The taper encourages a more arched or circular configuration when rods 40 are flexed to the expanded position. This results in expanding cover 12 in a more curved or circular configuration.

Figure 11:
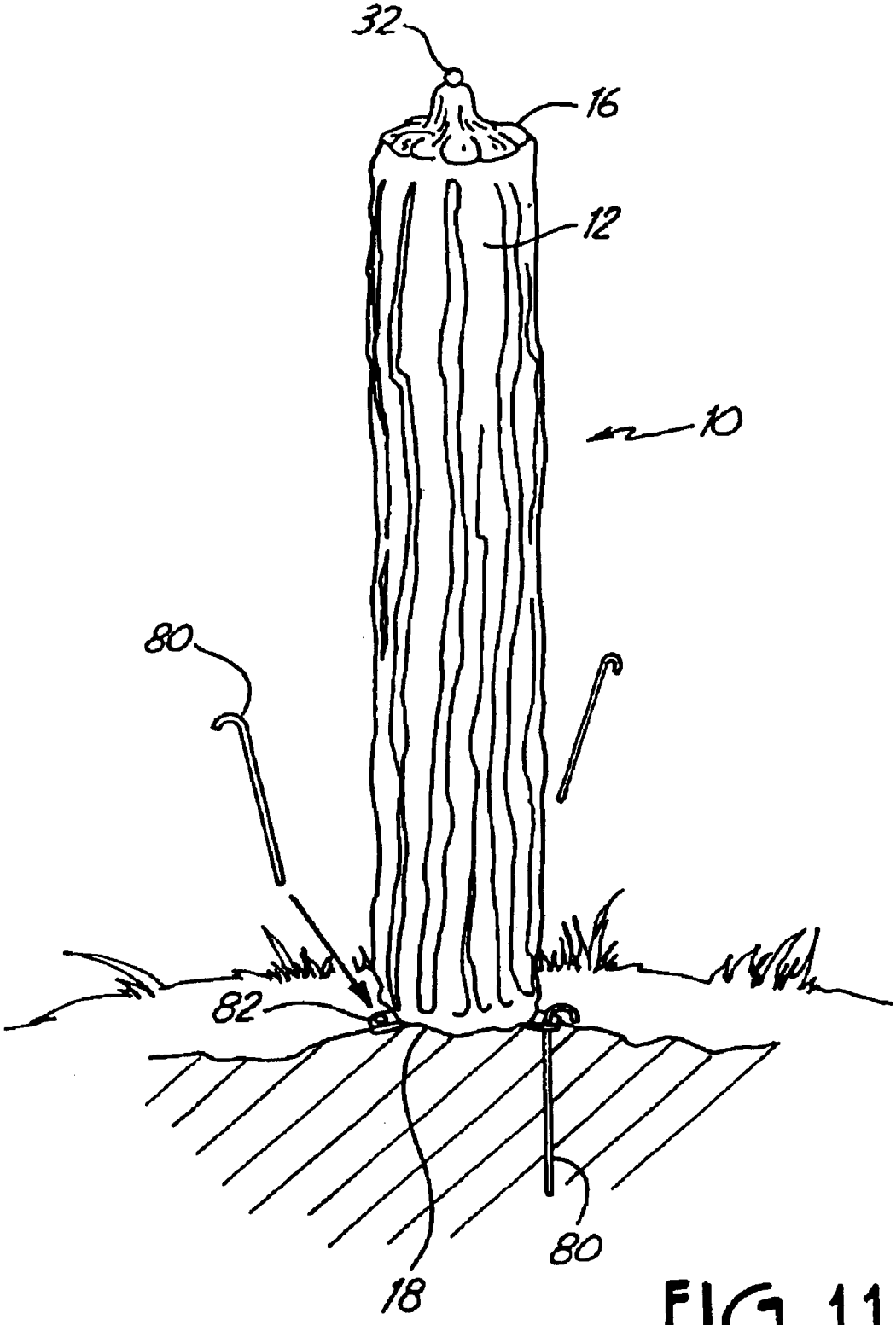
FIG. 11 is a side elevational view of an expandable decoration staked to the ground.

FIG. 11 illustrates expandable decoration 10 in a collapsed position and anchored to the ground. More specifically, lower base 18 may include one or more tabs 82 having a hole. Stakes 80 or other suitable anchoring devices can be passed through the holes in tabs 82 an driven into the ground to secure decoration 10. When expanded, decoration 10 will remain affixed to the ground.

Figure 12:
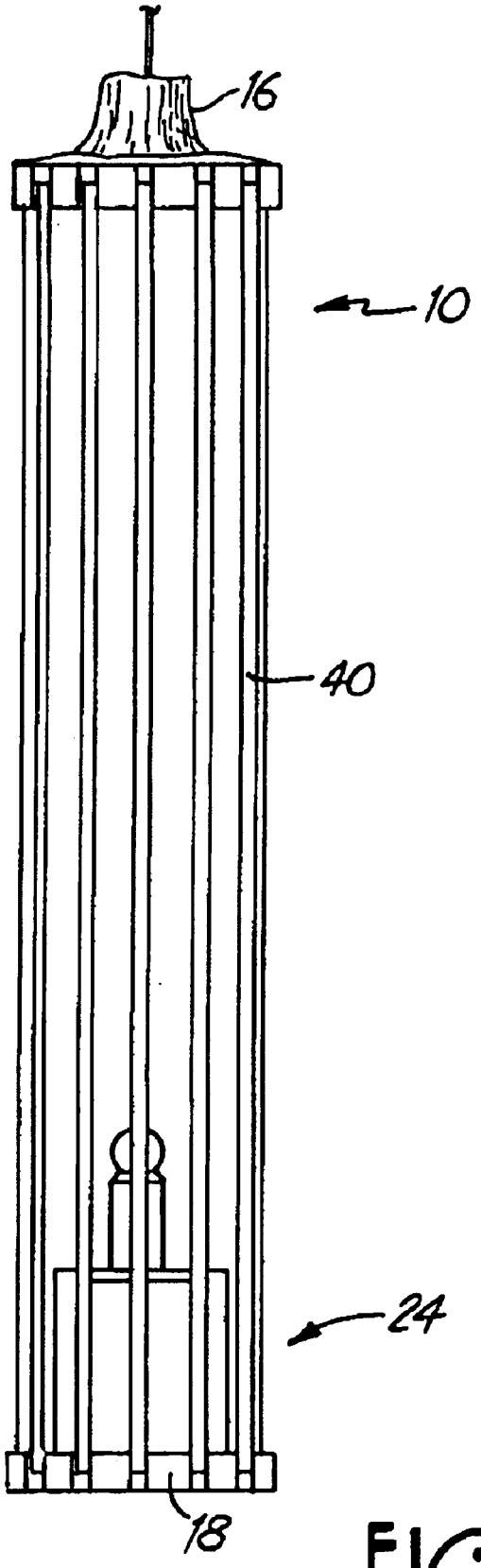
FIG. 12 is a side elevational view of a frame assembly and alternative lighting assembly consistent with the principals of the present invention.
Figure 13:
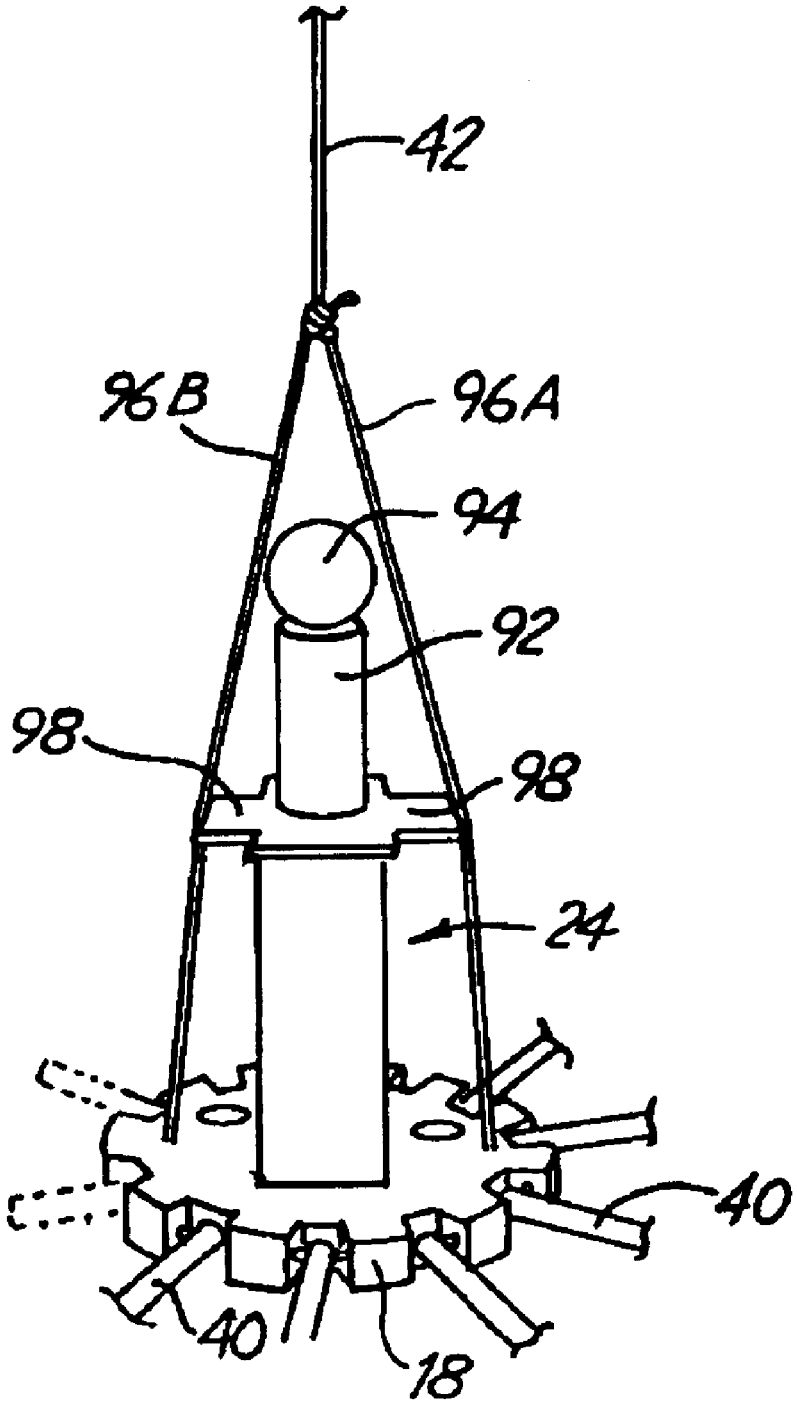
FIG. 13 is a side elevational view of the alternative lighting assembly of FIG. 12.

FIGS. 12 and 13 illustrate an alternative arrangement. More specifically, telescoping assembly 19 is not utilizes. Rather, upper base 16 and lower base 18 are interconnected only by rods 18 and cord 42. Lighting assembly 24 is coupled directly to lower base 18 and includes a battery compartment 90, a bulb assembly 92 and a bulb 94. Cord 42 is bifurcated near lower base 18 into cord extensions 96A and 96B. Extensions 96A and 96B are held apart by cord spacers 98. In use, cord 42 is pulled and rods 40 are caused to flex. While requiring fewer components, this embodiment is not as structurally rigid as the above described embodiment.

Although the present invention has been described with reference to preferred embodiments, persons skilled in the art will recognize that changes may be made in form and detail without departing from the spirit and scope of the invention.

We claim:

1. A device comprising:

first base;

a second base;

a telescoping assembly coupleable between the first base and the second base;

a plurality of rods, each rod having a first end and second end wherein each first end is pivotally coupleable with the first base and each second end is pivotally coupleable with the second base so that as the telescoping assembly contracts, the first base and the second base are caused to move towards one another and the rods are caused to flex, wherein the first end of each rod is tapered;

a cover positioned over the plurality of rods so that as the plurality of rods flex, the cover is expanded; and a cord having a first end and a second end, wherein the first end is operatively coupled with the first base and the second end is secured to the second base so that pulling the first end in a direction away from the first base causes the first base and the second base to move toward one another.

2. The device of claim 1, further comprising, a first bead coupled with the cord proximate the first end so that the cord is prevented from disengaging with the first base.

3. The device of claim 1, further comprising:

a key-hole slot through the first base; and a catch bead coupled with the cord so that the catch bead and the cord can be pulled through a first portion of the key-hole slot and caused to engage a second portion of the key hole slot.

4. The device of claim 3, further comprising, a guide pin coupled with the cord proximate the catch bead.

5. The device of claim 3, wherein the guide pin and the catch bead form an integral unit.

6. A device comprising:

first base;

a second base;

a plurality of flexible rods pivotally coupleable between the first base and the second base, wherein each rod has a first tapered end and second tapered end;

a lighting assembly disposed within an interior defined by the flexible rods;

a cover positionable around at least a portion of the flexible rods so that as the first base and the second base are caused to move toward one another, the flexible rods expand causing the cover to expand; and a cord having a first end and a second end, wherein the first end is operatively coupled with the first base and the second end is secured to the second base so that pulling the first end in a direction away from the first base causes the first base and the second base to move toward one another.

7. The device of claim 6 further comprising:

means for securing the cord when the device is in an expanded configuration.

8. The device of claim 6, further comprising, a first bead coupled with the cord proximate the first end so that the cord is prevented from disengaging with the first base.

9. The device of claim 6, further comprising:

a key-hole slot through the first base; and a catch bead coupled with the cord so that the catch bead and the cord can be pulled through a first portion of the key-hole slot and caused to engage a second portion of the key hole slot.

10. The device of claim 9, further comprising, a guide pin coupled with the cord proximate the catch bead.

11. The device of claim 6, wherein the second end of the cord is bifurcated into two extensions, wherein the two extensions are coupled with the second base.

12. The device of claim 11, further comprising:

a cord spacer coupled with the lighting assembly and positioned to space the cord from the lighting assembly.

* * * * *